US007585206B2

(12) United States Patent
Memmelaar, Sr. et al.

(10) Patent No.: US 7,585,206 B2
(45) Date of Patent: Sep. 8, 2009

(54) SPOOL TO SPOOL CONTINUOUS THROUGH FEED SYSTEM

(75) Inventors: John R. Memmelaar, Sr., Franklin Lakes, NJ (US); John R. Memmelaar, Jr., Midland Park, NJ (US); Todd R. Morris, New Windsor, NY (US); Arnold S. Bunagan, Ramsay, NJ (US)

(73) Assignee: Royal Master Grinders, Inc., Oakland, NJ (US)

( * ) Notice: Subject to any disclaimer, the term of this patent is extended or adjusted under 35 U.S.C. 154(b) by 0 days.

(21) Appl. No.: 12/009,831

(22) Filed: Jan. 22, 2008

(65) Prior Publication Data

US 2009/0186565 A1 Jul. 23, 2009

(51) Int. Cl.
*B24B 49/00* (2006.01)

(52) U.S. Cl. ..... 451/10; 451/11; 451/28; 451/54; 451/183; 452/907

(58) Field of Classification Search ..... 451/10, 451/11, 28, 54, 55, 167, 176, 183, 184, 260, 451/336, 907

See application file for complete search history.

(56) References Cited

U.S. PATENT DOCUMENTS 4,941,294 A 7/1990 Nakagaki et al.
5,036,629 A * 8/1991 Ishikuro et al. ..... 451/57
5,235,840 A * 8/1993 Blazevic ..... 72/201
5,658,618 A * 8/1997 Schlatter et al. ..... 427/444
5,701,656 A * 12/1997 Smith et al. ..... 29/558
5,772,495 A * 6/1998 Sanda et al. ..... 451/69
6,113,753 A * 9/2000 Washburn ..... 204/192.15
6,290,166 B1 9/2001 Aramaki et al.
6,390,894 B1 5/2002 Beel et al.
6,401,333 B1 6/2002 Suzuki et al.
6,591,890 B1 7/2003 Grubb et al.
6,643,445 B2 11/2003 Bumgarner et al.
6,830,209 B1 12/2004 Baenziger et al.
6,854,169 B2 * 2/2005 Love et al. ..... 29/81.06
6,908,362 B2 * 6/2005 Selvamanickam et al. ..... 451/28
7,077,724 B1 * 7/2006 Voges ..... 451/38
7,187,510 B2 * 3/2007 Yasunaga et al. ..... 360/16
2004/0069034 A1 * 4/2004 Seidel ..... 72/39

* cited by examiner

*Primary Examiner*—Eileen P. Morgan
(74) *Attorney, Agent, or Firm*—Lerner, David, Littenberg, Krumholz & Mentlik, LLP

(57) ABSTRACT

A grinding machine has a machine bed, a first spool and a second spool mounted on the machine bed. The spools are capable of storing stock to be ground and are rotatable in a coordinated manner. A grinding wheel is mounted on the machine bed. The first spool is capable of continuously unwrapping the stock, the second spool is capable of continuously wrapping the stock and the grinding wheel is adapted to grind the stock during its travel between the first spool and the second spool. The grinding machine can be used to continuously grinding a slender stock. The stock is continuously unwrapped from the first spool and continuously wrapped on the second spool. The stock is ground during its travel from first spool to the second spool.

18 Claims, 7 Drawing Sheets

SPOOL TO SPOOL CONTINUOUS THROUGH FEED SYSTEM

BACKGROUND OF THE INVENTION

1. Field of the Invention

The present invention relates to centerless grinders. More particularly the present invention relates to grinders wherein the stock is continuously unwrapped from a first spool and wrapped on a second spool during the process of grinding.

2. Description of the Related Art

Centerless grinders are well known machines for grinding elongated cylindrical workpieces such as medical guide wires, rods, pins, golf club shafts, antenna, fishing rods and similar articles. Conventional centerless grinders include a supporting structure on which a grinding wheel and a regulating wheel are mounted with their working surfaces facing each other and slightly separated. The workpiece is positioned between these two wheels ("the working area"). These wheels rotate in the same direction about a substantially horizontal axis at different speeds. The profile of the finished workpiece is controlled by moving the regulating wheel toward or away from the grinding wheel as the workpiece passes through the working area.

Since the workpiece's forward movement between the grinding wheel and the regulating wheel is controlled by the regulating wheel's speed and tilt angle (among other factors), slight changes in either of these factors can result in errors in the workpiece's desired grinding profile. In order to prevent such errors, systems employing optical sensors, such as those disclosed in U.S. Pat. No. 5,480,342 to Royal Master Grinders, Inc., the assignee of the present application, are used to precisely detect the workpiece's position and to move the regulating wheel in response to this detected position.

However, for elongated workpieces fabricated from wire stock shipped on spools, the grinding process can begin for a particular set of workpieces only after the wire is dispensed by hand from the spool and cut into a plurality of equal lengths. Each length of wire then must be placed into a feeder for transmitting the wire through the working area. These steps substantially delay the manufacturing process. Therefore, there is a need for a grinding machine that would continuously feed the wire past the grinding wheel and simultaneously continuously wrap the ground wire on a spool.

SUMMARY OF THE INVENTION

The present invention, in one aspect, teaches a grinding machine having a machine bed. A first spool mechanism having a first spool and a second spool mechanism having a second spool mounted on the machine bed. The first spool mechanism and the second spool mechanism are capable of storing stock to be ground. The first spool mechanism and the second spool mechanism are rotatable in a coordinated manner to rotate the stock. A grinding wheel is mounted on the machine bed. The first spool is capable of continuously unwrapping the stock, the second spool is capable of continuously wrapping the stock and the grinding wheel is adapted to grind the stock during its travel between the first spool and the second spool.

In another aspect, the present invention teaches a method of continuously grinding a slender stock. The stock is continuously unwrapped from the first spool and continuously wrapped on the second spool. The stock is ground during its travel from first spool to the second spool.

In another aspect, the present invention teaches a machine tool for continuously processing a slender stock. The machine tool has a first spool assembly having a first spool, and a second spool assembly having a second spool. A tool is located between the first spool assembly and the second spool assembly. A bed supports the first spool assembly, the second spool assembly and the tool. The tool is capable of continuously performing an operation on a stock while it is being unwrapped from the first spool and wrapped on the second spool.

DETAILED DESCRIPTION

Figure 1:
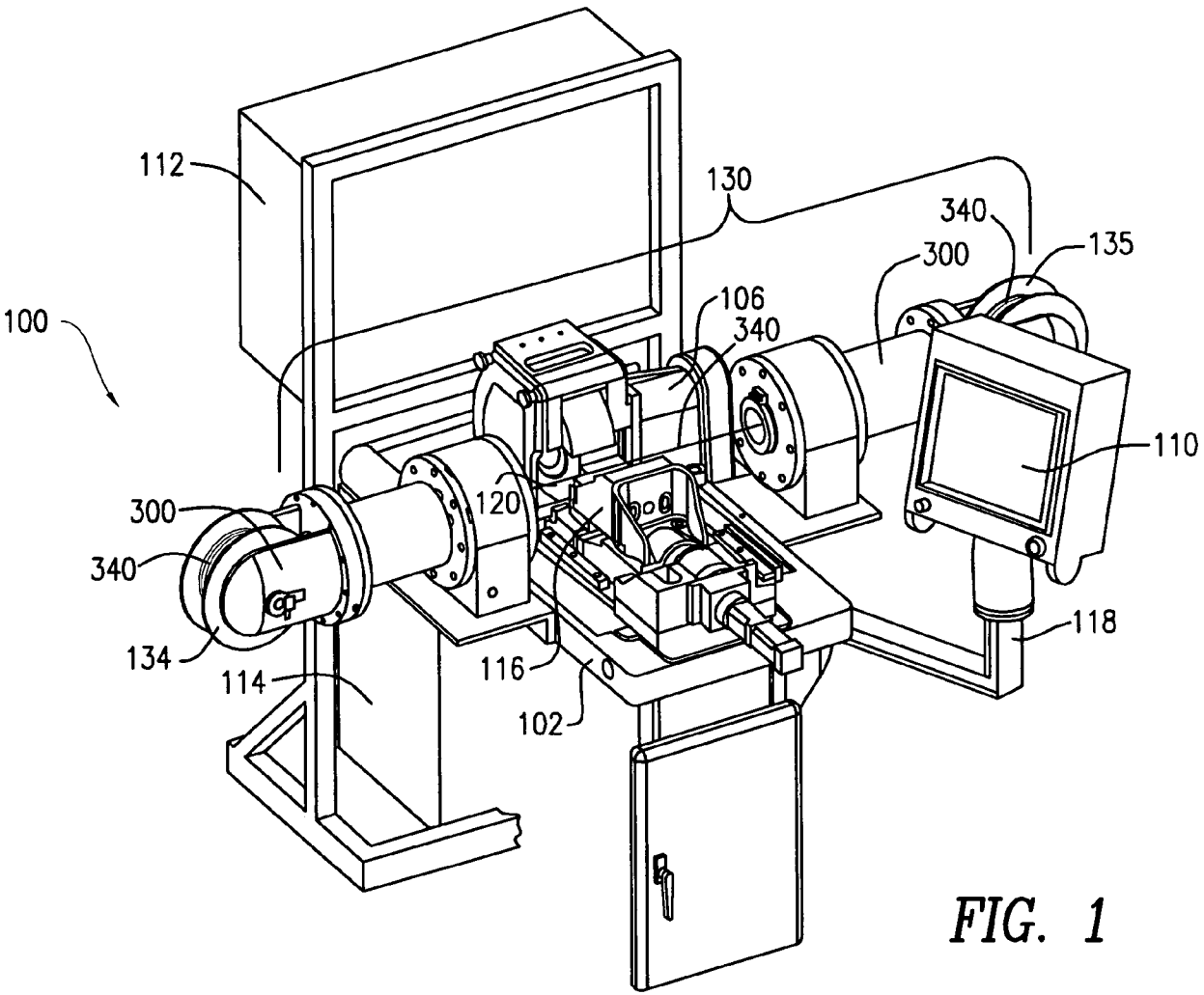
FIG. 1 shows a centerless grinding machine of the present invention.

FIG. 1 shows a grinding machine 100. Machine 100 includes a machine base 102 (alternatively called machine bed). Machine base 102 may be made using known methods. Machine base 102 may be an iron bed that is stress relieved and normalized and then ground for flatness and parallelism of the structures on the bed. A main spindle may be mounted on machine base 102. The main spindle may be housed in a counterweighted weldment 106 that also houses the main spindle drive motor. Weldment 106 may also house adjustment plate, machine electronic, and optionally a hydraulic tank and pump assembly.

A machine control interface swingarm 108 is mounted on machine base 102. Machine control interface swing arm 108 houses the machine's master computer including a touch screen interface 110. All functions of grinding machine 100 may be controlled via machine's master computer. The master computer may be located in any other suitable position and connected to grinding machine 100.

An electrical control cabinet 112 is located adjacent to machine base 102. All machine control hardware, input/output modules, relays, servo drives and motion controllers may be located in electrical control cabinet 112. Electrical connections to various parts of grinding machine 100 may be made through quick disconnect plugs for ease of movement. Electrical control cabinet 112 may be located at any suitable location and the electrical connections may be made using any method and hardware known to one skilled in the art.

A coolant tank and pump assembly may be located in machine base 102 or any other suitable location. In one exemplary embodiment, coolant and delivery pump may be housed in a sheet steel forty gallon tank 114. The pump may be a 10 GPM centrifugal unit powered by a ⅙ hp sealed electric motor. Any other suitable pump may be used. Tank 114 may have two or more compartments separated by individual insertions (partitions) to improve settling of sludge produced during grinding.

A ram bed assembly 116 is mounted on machine base 102. Ram bed assembly 116 has a linear motion axis. The movement of the ram along the linear motion axis may be computer controlled. The movement of the ram along the linear motion axis determines final size of the work piece. The movement of the ram along the linear motion axis, for example, is generated through a servo motor coupled to a planetary gearbox that drives a custom ground ball screw drive line. Any other suitable arrangement for movement of the ram along the linear motion axis may be used. The position of ram may be controlled via a motion controller that may be part of the master computer. A 0.1 micron linear glass scale may be used to precisely move and locate the ram. Alternatively, any other suitable method and scale for precise location and movement of the ram may also be used. Customer specific tooling, including bushings or support blades, may be mounted on the ram and moved toward and away from the work zone to determine final part geometry. Final part geometry may be controlled with tooling and the ram axis movement. If bushings are to be used, the bushing diameters may be of tight tolerance, within 0.0002 inch, and may be sized to match the work piece diameter. The work piece is inserted inside the bushing for machining. The movement of the ram along the linear motion axis moves the work piece into the work wheel. The glass scale controls the ram axis position, thus controlling the work piece size. Any other form of tooling may function in similar ways and hold the work piece in position while the ram axis moves the tooling along with the work piece into the work wheel.

A main spindle assembly (also known as head stock assembly) may be housed in counterweighted weldment 106. The main spindle assembly includes a grinding wheel 120 mounted on a precision work wheel spindle. The work wheel spindle may be of a cantilever design to allow the operator easy access to the work wheel for wheel change and setup. Three duplex pairs of class seven ABEC angular contact ball bearings may be used in the design for extreme accuracy. The preloaded ball bearing design, such as the duplex pairs of class seven ABEC angular contact ball bearings, requires no spindle warm up time. Alternatively, any other suitable bearings or means of rotational mountings may be used. The spindle may be fitted with lubed for life bearings and labyrinth seals at each end to ensure a contamination free life. This complete unit is installed in a normalized and stress relieved cast iron headstock to assure vibration free operation. The head stock is mounted on machine base 102. Grinding wheel 120 having a 12" diameter, 4" face and 5" bore may be mounted on the main spindle. Alternatively, grinding wheel of a different size may be mounted on the taper lock main spindle. The spindle may be belt driven and may run at up to 3300 rpm. Such spindle speed may results in a maximum wheel surface velocity of 10,500 sf/m and thereby allow the use of super abrasive grinding wheels. In another embodiment, spindle speed above or below 3300 rpm may be used.

Grinding machine 100 may also include one or more spool-to-spool assembly 130. Spool-to-spool assembly 130 includes two separate multi axis coordinated spool mechanism 132 (FIG. 2) that will continuously feed material from a spool 134, process it, and wrap it on another spool 135. Spool-to-spool assembly 130 may be used, for example, in grinding, heat treatment, polymer coating or any other process where continuous feed of work piece is desired. One embodiment of the spool-to-spool assembly 130 is used in the grinding machine 100 used to grind diameter products including guidewires. Although an embodiment using the spool-to-spool assembly in a grinding operation is described, the assembly could be used in heat treatment or polymer coating operation or perform any other operation by replacing the grinding wheel by an appropriate set-up (or tooling) to continuously heat treat or polymer coat or perform any other continuous operation on the stock.

Figure 2:
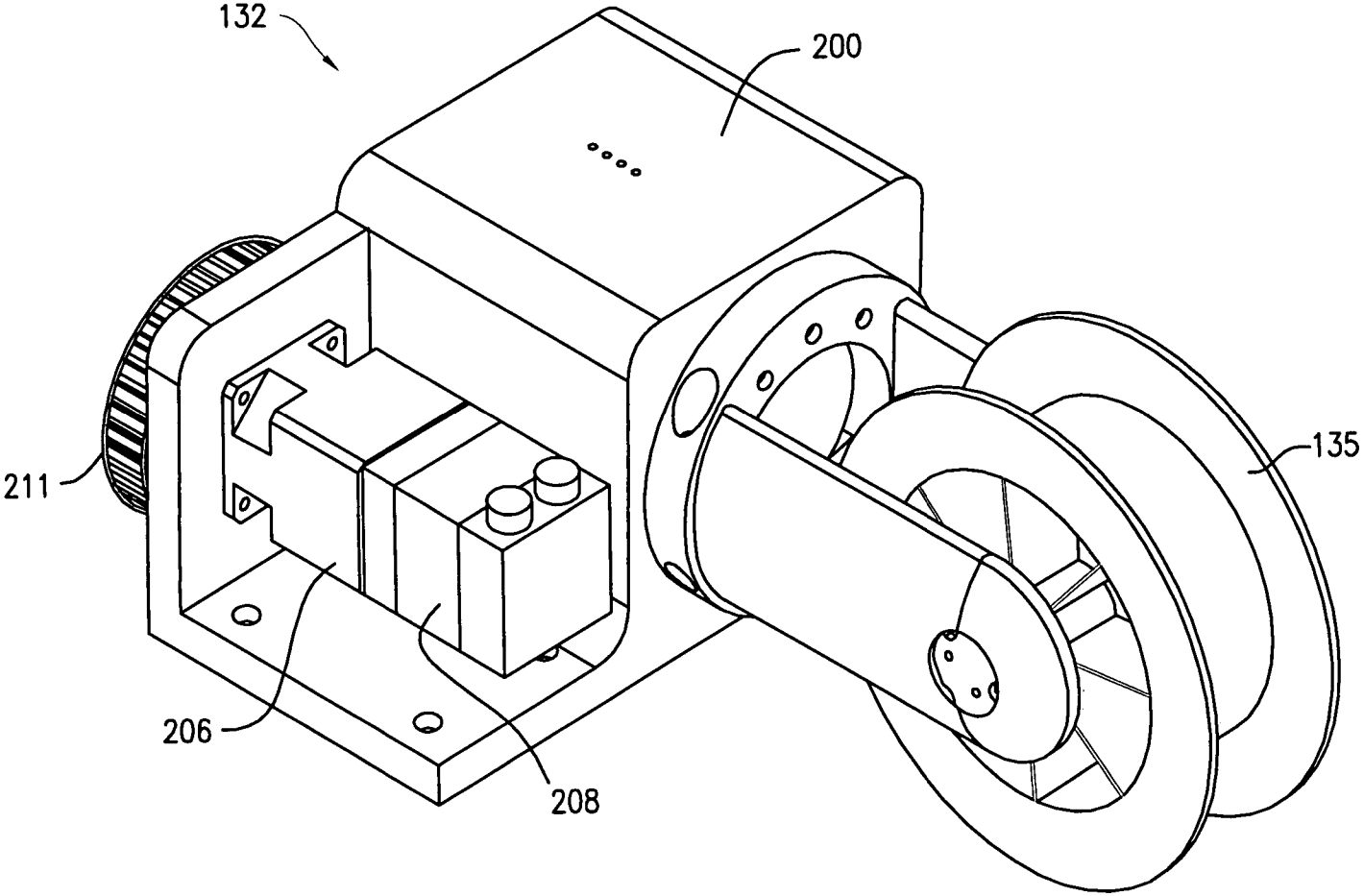
FIG. 2 is an isometric view of the spool mechanism of the centerless grinding machine of FIG. 1.
Figure 3:
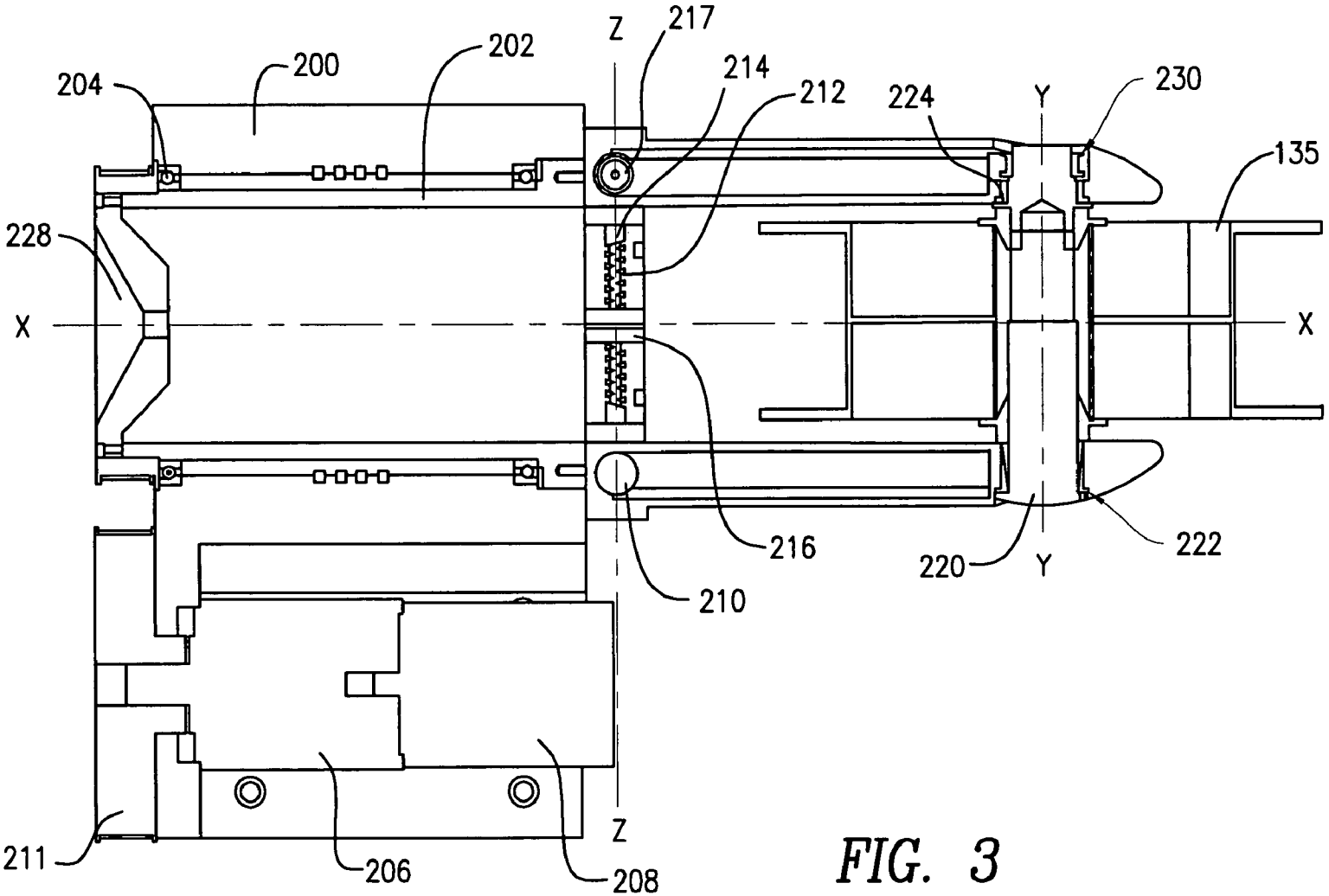
FIG. 3 is a cross-sectional view of the spool mechanism of the centerless grinding machine of FIG. 1 showing the internal components of the spool mechanism.

FIGS. 2 and 3 show an exemplary spool mechanism 132 that may be used to wrap or unwrap the stock. Spool mechanism 132 includes a main housing 200 that houses a main spindle 202. Main spindle 202 may be 8 inches long and 5.5 inches in diameter. The size of the main spindle may be changed as necessary for different embodiments. Main spindle 202 is mounted in two angular contact spindle bearings 204. Any other suitable bearing and bearing configuration may be used. Main spindle 202 is coupled to a main spindle gearbox 206. Main spindle gearbox 206 in turn is coupled to a main spindle servo motor 208 that drives the main spindle via coupling between driven pulley 209 and driving pulley 211.

A gearmotor 210 for level mounting mechanism is also included in spool mechanism 132. Gearmotor 210 is coupled to a level winding mechanism 212. Level winding mechanism 212 includes a level wind screw 214 and guide shoe 216 mated with the level wind screw 214. Gearmotor 210 drives level winding mechanism 212 so that guide shoe 216 reciprocates on level wind screw 214 at appropriate speed so as to result in level winding of the stock on spool 135. Level winding mechanism 212 also includes a replaceable carbide guide that would resist wear and thereby ensure long life at high speed.

Spool 135 is mounted on a spindle 220 that in turn is mounted in long bearing 222 and short bearing 224. A timing pulley 230 is coupled with spindle 220. The timing pulley 230 allows the rotations of the spool 135 to be coordinated with the rotations of the spool 134. Spool mechanism 132 also includes a centering cone 228 located in the main housing 200. Centering cone 228 centers the stock such that the stock is positioned suitably for the grinding. The centering cone also assures that the stock rotates around its own axis and does not revolve off-center around a central axis. A motor is coupled to spool 134 and a second motor is coupled to spool 135. These motors rotate spools 134 and 135 to unwrap and wrap the stock, respectively. The action of these motors may be coordinated to ensure that there is no "bailing up" of the stock. The bailing up of the stock is a condition wherein the stock is unwound at a rate faster than it is wound resulting in collection of excess stock that is not tightly stretched.

Figure 4:
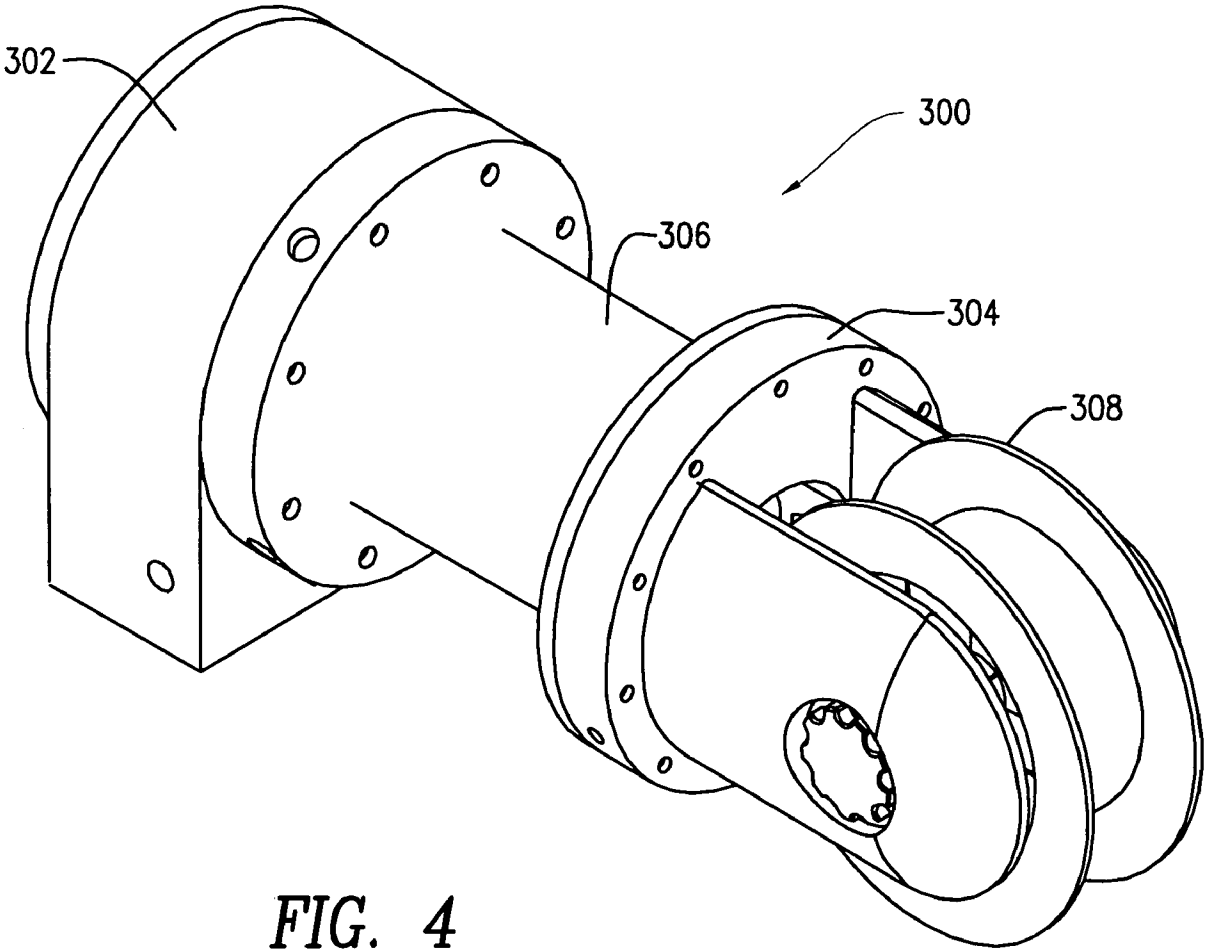
FIG. 4 is an isometric view of another embodiment of the spool mechanism of the centerless grinding machine of FIG. 1.
Figure 5:
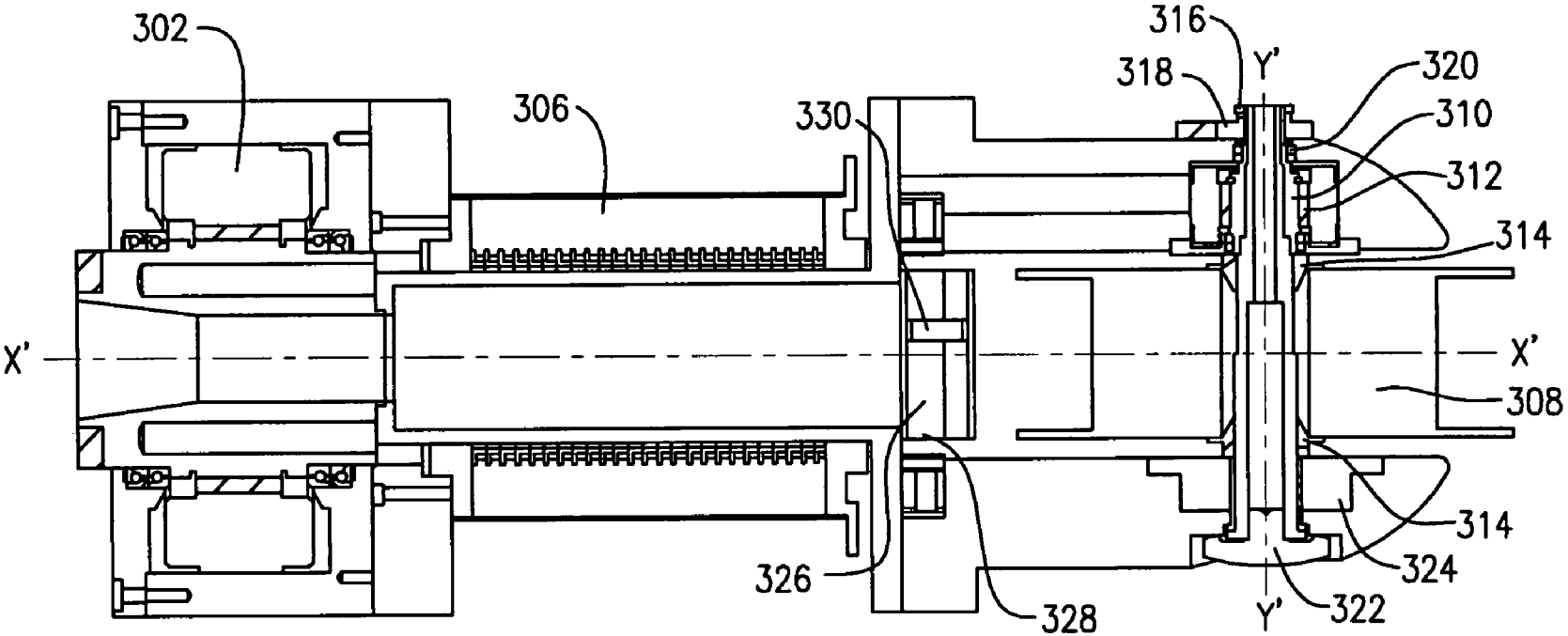
FIG. 5 is a cross-sectional view of the spool mechanism of FIG. 4 showing the internal components of the spool mechanism.
Figure 6:
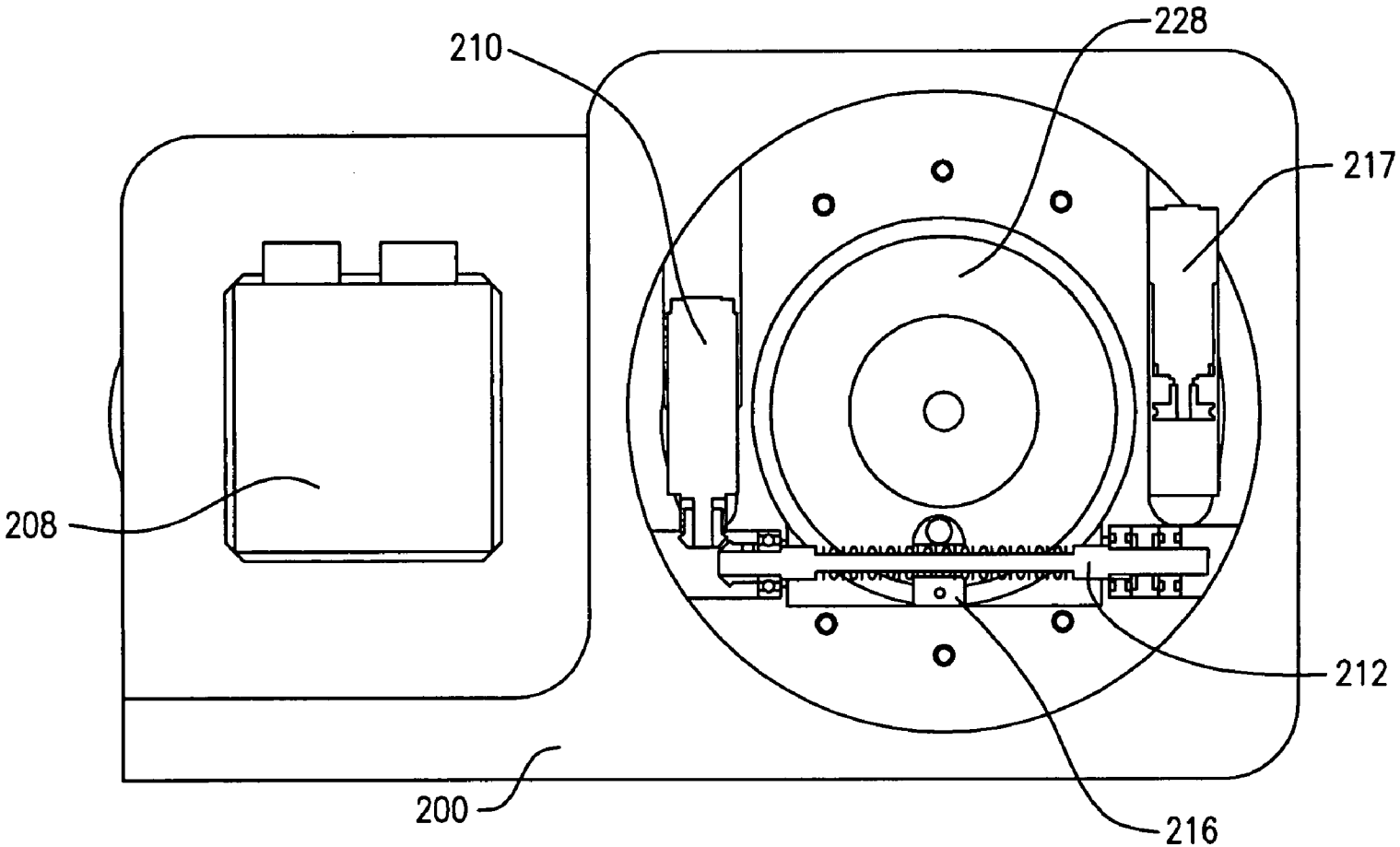
FIG. 6 is a cross-sectional view along line zz shown in FIG. 3.
Figure 7:
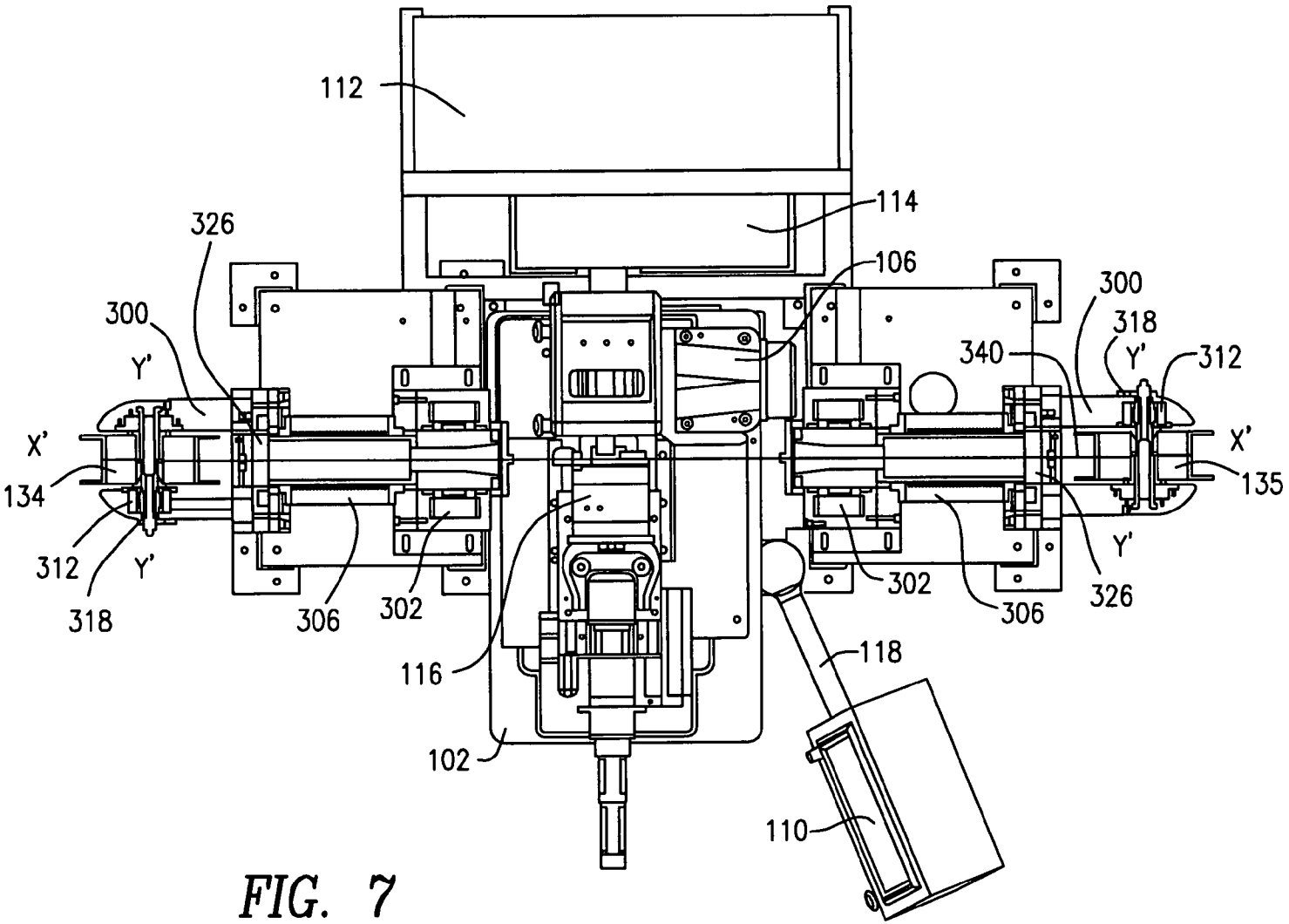
FIG. 7 is a top plan view of FIG. 1.

One embodiment of spool-to-spool assembly 130 shown in FIGS. 4 and 5 uses two rotary servo motors 302, two linear servo motors 326 and two rotary servo motors 310. Another embodiment of spool-to-spool assembly 130 shown in FIG. 3 uses two rotary servo motors 208, two rotary servo motors 210 and two rotary servo motors 217. FIG. 6 shows rotary servo motor 208, rotary servo motor 210 and rotary servo motor 217. The rotary servo motors 208, rotary servo motors 210 and rotary servo motors 217 are rotary servo motors that may direct drive servo motors with no gear boxes. The load may be attached directly to the motor spindle. The linear servo motor may be a rotary motor that has been flattened. Rotary servo motors 208 rotate the Spools 134 and 135 around the work pieces longitudinal axis X-X (FIG. 3). Rotary servo motors 210 drives the level winding mechanism 212. Rotary servo motors 217 rotate each quick change spindles of spools 134 and 135 around their axis Y-Y (FIG. 3) and thereby rotate spools 134 and 135 respectively around axes Y-Y.

Rotary servo motors 208 may be electronically or manually coupled for fully coordinated motion. In another embodiment, motor 217 for rotating spools 134 or 135 around axis Y-Y and rotary motor 210 may be electronically or manually coupled. Servo motor 208 that rotate the spool (134 or 135) around the work piece longitudinal axis may also be called the "main wire rotation motor." Servomotor 208 that rotates spool 134 (around axis X-X) and servo motor 208 that rotates spool 135 (around axis X-X) rotate the spools at the same velocity throughout the grinding process. The velocity is checked and controlled with the use of an encoder on each axis. Servo motors 217 may also be called "wrap motors." Servo motors 217 rotate the wrap/unwrap spools (i.e., spools 134 and 135), and are also electronically coupled. Servo motors 217 are computer controlled for proper rotation rates and are checked with encoders.

Main wire rotation encoder, wire wrap encoder and level wind encoder are used to check position of all axes of motion. The encoders are mechanically coupled to each axis of motion, rotary or linear. The encoders have two parts. The encoders have a reader and a scale. The scale is attached to the part whose position is to be determined. The encoder reads the scale and thereby determines the position of the part to which the scale is attached. This is done so that the precise positioning and placement of the work piece can be assured. The master computer may use the position on the respective rotation axis for each spool to calculate the proper rotation rate of the wrap motor and linear position of the level winding mechanism 212. Using the known values for wire wrap rotation rate, wire diameter and through put rate the level wind position can be calculated. And, as the workpiece is continually ground the level wind position can be updated to ensure that the winding is smooth and even. The proper rotation rate of the wrap motor and linear position of the level winding mechanism 212 are essential to getting a neat and level wrap on spool 135. Controlling the position of the ram axis allows control of the part profile.

The rotary electrical connections for the motors may be made through slip ring hardware. The use of slip ring hardware may result in maximum axial rotation rate of about 2000 RPM for the servo motors 208. Programmable or settable stops for each multi axis coordinated spool mechanism 132 will allow use of spools 134 and 135 of various width and diameter to be used as desired. The diameter of the spool 134 (or spool 135), wire diameter, spool width, and the wrap rate will determine the position of the stop.

Programmable stops simplify the mechanical assembly and eliminate mechanical components. The level wind motor needs to move across the face of the spool 135 at a rate that will evenly distribute the wire on the spool 135 without building up in any one given spot. As the wire diameter changes the move distance across the spool 135 changes. The stops will keep the level wind function operating properly. The "stop" stops the level wind motor at a predetermined position and thereby avoids buildup.

For ease of stock change over the spool spindle may be of a quick change design. Any suitable quick change method and apparatus known to one skilled in the art may be used. In one embodiment, width of spool 135 (or 134) may be limited to 4 inch and the maximum diameter of the grinding wheel may be limited to 12 inch.

The programmable rotational rates for spools 134 and 135 allow for precise control of wrapping tension and also keep the unwrapping stock from "bailing up". Rapid rewind of the stock is possible as each wrapping and unwrapping units are bidirectional. Maximum rotational wrapping rates of 5000 RPM are possible. A replaceable carbide guide is used on the level winding assembly to ensure long life at elevated speeds. The level winding assembly may be of any form known to one skilled in the art.

Spools 134, 135 and the stock may also rotate around an axis while processes (such as grinding, heat treatment or coating) are preformed on the stock. While a process takes place, the stock is unwrapped and rewrapped from two spools 134 and 135 respectively. The level winding mechanism keeps the stock uniformly distributed on the spool on which the processed stock is being wrapped. Thus, during the process such as grinding, spools 134, 135 each rotate around a separate axis Y-Y passing through their center to unwrap and rewrap the stock. Additionally, spools 134 and 135 and the stock rotate around a second axis X-X, thereby imparting rotation to the stock on which the process is being performed. In an alternative embodiment, in place of rotation of the stock around the axis X-X, grinding wheel 120 may be rotated around the stock while grinding wheel 120 also rotates around its own axis.

FIGS. 4 and 5 show another embodiment of spool mechanism 300. Two spool mechanisms 300 are included in a spool-to-spool assembly 130 that will continuously feed material from one spool and wrap it on the other spool. Features described in context of the embodiment of FIGS. 2 and 3 may also be used with the embodiment of FIGS. 4 and 5 and vice versa. In the embodiment of FIG. 4, spool mechanism 300 includes a wire rotation servomotor 302. Wire rotation servomotors 302 of the two spool mechanisms 300 are coupled either electrically and/or mechanically. Spool mechanism 300 includes a yoke assembly 304 coupled to the wire rotation servomotor 302 via a slip ring 306. A spool 308 is coupled to the yoke assembly 130. The spool 308 has a spindle 310 directly driven by a wire wrap servomotor 312. Spindle 310 may be supported in bearings 320. The spool 308 is mounted on the spindle 310 using two centering cones 314. A circlip 316 is mounted on one end of the spindle 310 to prevent the spindle 310 from sliding out of position. The circlip 316 and a handle 322 on the opposing end from the circlip 316 help performing a quick change of spindle if necessary. A counter weight 324 is located adjacent the handle 322. An encoder wheel 318 having an encoder read head 320 is mounted on the spindle 310 between the circlip 316 and the yoke assembly 304. The rotation of the spindle 310 is monitored via the encoder read head 320.

A level wind motor for level mounting mechanism is also included in spool mechanism 300. Level wind motor 326 may be a servomotor. Level wind motor 326 drives level winding mechanism so that guide shoe 330 reciprocates on level wind screw 328 at appropriate speed so as to result in level winding of the stock on spool 308. The action of level wind motor 326 is coordinated with the action of wire wrap servomotor 312 to ensure that the winding of wire stock 340 on spool 308 is level. Such coordination may be achieved via coupling the level wind motor 326 to the wire wrap servomotor 312 either electrically and/or mechanically. Level winding mechanism also includes a replaceable carbide guide that would resist wear and thereby ensure long life at high speed. Spool mechanism 300 may also includes a centering cone for centering the stock such that the stock is positioned suitably for the grinding.

A grinding machine using any one of the spool-to spool assembly 130 may be used to continuously process a piece of stock as described hereafter. The stock final diameter may have any combination of straight and tapered sections. To start continuous grinding of stock, the wire rotation servomotors 302 are coupled to each other, the level wind motor 326 is coupled to wire wrap servomotor 312 and the grinder set-up is completed. First spool mechanism 300 having the stock to be ground is mounted on one side of the grinding wheel and second spool mechanism 300 on which the processed stock is to be wrapped is positioned on the other side of the grinding wheel. Next, a length of stock is manually unwrapped from the first spool mechanism 300, fed through the machine past the grinding wheel and loaded on second spool mechanism 300. The presence of stock near the grinding wheel may be monitored via a proximity sensor.

After the "loading" process is complete the wire rotation servomotors 302 are electronically started through the master computer. After they reach their specified rotational rpm, the grinding process can be started. At this time the ram is brought into proper position for final stock size and the wire wrap servomotors 312 in each of the spool mechanisms 300 begin their appropriate rotation to unwrap and wrap the stock. At this time the grinding wheel is rotating at desired rpm and the stock passing by the grinding wheel is ground to the desired size and profile. The ground stock is wrapped on the spool of the second spool mechanism 300.

During the grinding, wire rotation servomotors 302 are coupled matching their respective rotation rates. Their rotation rates are controlled via a motion controller and their encoders respectively. At level wind motor 326, first spool mechanism 300 reciprocates across the width of the spool as wire 340 is fed into the grinder. The wrap motor 312 is varying the rpm according to the spool diameter and wire diameter to unwind the wire 340 at a constant rate. The wire wrap servomotor 312 is coordinated with the level wind motor 326 to ensure that the stock is properly fed to the grinder. At second spool mechanism 300, level wind motor 326 reciprocates, coordinated to the wire wrap servomotor 312, continuously laying the ground stock neatly across the width of the spool. The wire wrap servomotor 312 is varying rpm according to the spool diameter and the wire diameter to keep the layers neat and the through put rate of the machine constant.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A grinding machine comprising:

a machine bed;

a first spool mechanism having a first spool rotatably mounted about a first axis and a second spool mechanism having a second spool rotatably mounted about a second axis parallel to the first axis, the first spool mechanism and the second spool mechanism being mounted on the machine bed and being capable of storing stock to be ground, the first spool mechanism and the second spool mechanism being rotatable about a third axis transverse to the first and second axes in a coordinated manner to rotate the stock, wherein the first spool is capable of continuously unwrapping the stock, and the second spool is capable of continuously wrapping the stock; and a grinding wheel mounted on the machine bed between the first spool mechanism and the second spool mechanism, the grinding wheel being adapted to grind the stock as the stock travels between the first spool and the second spool.

2. The grinding machine of claim 1, further comprising:

a first motor coupled to the first spool mechanism; and a second motor coupled to the second spool mechanism, wherein the first and the second motors rotate the first and the second spool mechanisms respectively thereby rotating the stock about the third axis.

3. The grinding machine of claim 2, wherein the first and the second motors are coupled mechanically or electronically.

4. The grinding machine of claim 3, further comprising:

a third motor coupled to the first spool; and a fourth motor coupled to the second spool, wherein the third motor rotates the first spool about the first axis to unwrap the stock, and the fourth motor rotates the second spool about the second axis to wrap the stock.

5. The grinding machine of claim 4, wherein at least one of the third motor or the fourth motor is directly coupled to a spindle of the first spool or the second spool respectively.

6. The grinding machine of claim 4, further comprising:

a level winding mechanism coupled to at least one of the first spool or the second spool, the motion of the level winding mechanism being coordinated with the rotation of the spool to which it is coupled thereby resulting in level winding of the stock on the spool.

7. The grinding machine of claim 6, further comprising at least one centering cone for centering the stock with respect to the first or the second spool.

8. The grinding machine of claim 7, wherein the at least one of the first spool and the second spool is mounted on a quick change spindle.

9. The grinding machine of claim 8, further comprising an encoder mounted on the quick change spindle, the encoder allowing the coordination of the rotation of the spool and the level winding mechanism.

10. A method of continuously grinding a slender stock comprising the steps of:

continuously unwrapping the stock from a first spool rotatably mounted about a first axis;

continuously wrapping the stock on a second spool rotatably mounted about a second axis parallel to the first axis;

simultaneously rotating the first and second spools about a third axis transverse to the first and second axes, while the first and second spools rotate about the first and second axes, respectively; and grinding the stock during its travel from first spool to the second spool.

11. The method of claim 10, further comprising the steps of:

coordinating the rotation of the first spool and the second spool to ensure that there is no bailing up of the stock.

12. The method of claim 10, further comprising the steps of:

controlling rotation rates of the first spool and the second spool to ensure proper wrapping tension.

13. The method of claim 10, wherein the step of simultaneously rotating the first and second spools about a third axis rotates the stock around the third axis.

14. The method of claim 13, further comprising:

level winding the stock on the second spool by coordinating the rotation of the second spool and a level winding mechanism.

15. The method of claim 14, wherein the coordination is done mechanically or electronically.

16. The method of claim 10, wherein said third axis is transverse to said first and second axes.

17. A machine tool for continuously processing a slender stock comprising:

a first spool assembly having a first spool rotatable about a first axis;

a second spool assembly having a second spool rotatable about a second axis parallel to the first axis;

a tool located between the first spool assembly and the second spool assembly; and a bed supporting the first spool assembly, the second spool assembly and the tool, wherein the tool is capable of continuously performing an operation on a stock while it is being unwrapped from the first spool and wrapped on the second spool and wherein the first and second spool assemblies are capable of simultaneously rotating about a third axis transverse to the first and second axes, while the first and second spools rotate about the first and second axes, respectively.

18. The machine tool of claim 17, wherein the tool is a grinding tool, a heat treatment set-up or a polymer coating set-up.

* * * * *